US006789648B2

(12) United States Patent
Cook

(10) Patent No.: US 6,789,648 B2
(45) Date of Patent: Sep. 14, 2004

(54) RETRACTABLE LADDER ASSEMBLY

(75) Inventor: Gregory D. Cook, Duncan, OK (US)

(73) Assignee: Cook Manufacturing Corporation, Duncan, OK (US)

( * ) Notice: Subject to any disclaimer, the term of this patent is extended or adjusted under 35 U.S.C. 154(b) by 0 days.

(21) Appl. No.: 10/339,065

(22) Filed: Jan. 8, 2003

(65) Prior Publication Data

US 2003/0127284 A1 Jul. 10, 2003

Related U.S. Application Data

(60) Provisional application No. 60/346,948, filed on Jan. 8, 2002.

(51) Int. Cl.[7] ..... E06C 5/00
(52) U.S. Cl. ..... 182/86; 114/362
(58) Field of Search ..... 182/86, 88, 93, 182/97, 127; 114/362; 280/166

(56) References Cited

U.S. PATENT DOCUMENTS 3,305,045 A * 2/1967 Schlecht ..... 182/97
4,205,862 A * 6/1980 Tarvin ..... 280/166
4,708,355 A * 11/1987 Tiede ..... 280/166
4,896,744 A * 1/1990 Crone ..... 182/88

FOREIGN PATENT DOCUMENTS

JP 03090493 A * 4/1991 ..... B63B/27/14

* cited by examiner

*Primary Examiner*—Alvin Chin-Shue
(74) *Attorney, Agent, or Firm*—Fellers, Snider, et al.; Bill D. McCarthy

(57) ABSTRACT

A retractable ladder assembly for marine applications having a frame and a ladder having a pair of channel members pivotally connected to the frame and extendible there from in a vertical position and in a horizontal position. A plurality of rung members extend between the channel members, and channel extension members are slidably supported in the channel members. A pair of strut connectors have one end pivotally connected to the frame and the other end pivotally connected to the lower ends of the channel extension members. A power actuator is supported by the frame to pivot the channel members between a vertical position and a horizontal position, the channel extension members extending from the upper ends of the channel members in the vertical position and are contained in the channel members in the horizontal position.

13 Claims, 5 Drawing Sheets

RETRACTABLE LADDER ASSEMBLY

RELATED APPLICATION

This application claims priority to U.S. Provisional Application No. 60/346,948 filed Jan. 8, 2002 entitled "Retractable Ladder Assembly."

FIELD OF INVENTION

The present invention relates generally to the field of folding ladders and the like, and in particular but not by way of limitation, to a retractable ladder assembly for use in marine applications such as pontoon type boats and platforms.

BACKGROUND OF INVENTION

Boarding a pontoon boat from the water on which the boat is floating, or pulling oneself from a body of water to a dock platform, presents a challenging physical problem to many people. Without the use of a ladder, this task can be quite difficult in the least, so detachable ladders have frequently been utilized to facilitate such activity. However, detachable manual ladders are heavy, cumbersome and often too large to be stowed on the boat or near the dock.

Furthermore, detachable ladders that are used on decks or other marine platforms often are left out and not returned to storage after usage, cluttering passageways and can create unsafe obstructions to traffic. Further, storage locations for ladders often are inconvenient, distant or time consuming to accommodate.

Thus, it is clear that there is a need for ladders that can be deployed in marine locations where space is restricted or where other environmental conditions make the use of conventional ladders difficult and impractical. For example, for many people, especially elderly and physically challenged persons, the handling for deployment and stowage of conventional ladders is a struggle, and especially unsafe in marine environments where maneuvering space is restricted. There are many such marine locations where it would be desirable to have a deployable ladder that can be readily stowed in instant, off deck storage.

There is therefore a continuing need for an accurate and fast method to deploy and store a ladder in marine and other environments where space is restricted and storage difficult and/or inconvenient, where manual deployment and storage return bring risk of unsafe practices, and to address other limitations associated with the current state of the art.

SUMMARY

The present invention provides for marine applications having a frame, and a ladder having a pair of channel members pivotally connected to the frame and extendible there from in a vertical position and in a horizontal position. A plurality of rung members extend between the channel members, and channel extension members are slidably supported in the channel members. A pair of strut connectors have one end pivotally connected to the frame and the other end pivotally connected to the lower ends of the channel extension members.

A power actuator is supported by the frame to pivot the channel members between a vertical position and a horizontal position, the channel extension members extending from the upper ends of the channel members in the vertical position and are contained in the channel members in the horizontal position.

The components of the retractable ladder assembly are selected to be corrosion resistant for marine environments.

Other features, benefits and advantages which characterize the claimed invention will become apparent upon reading the following detailed description in view of the associated drawings and appended claims.

BRIEF DESCRIPTION OF DRAWINGS AND APPENDIXES

FIG. 6 is a side, elevational view of the retractable ladder assembly of FIG. 1 in the retracted position

FIG. 8 is a diagrammatical representation of the control of the retractable ladder assembly of FIG. 1.

DESCRIPTION

Figure 1:
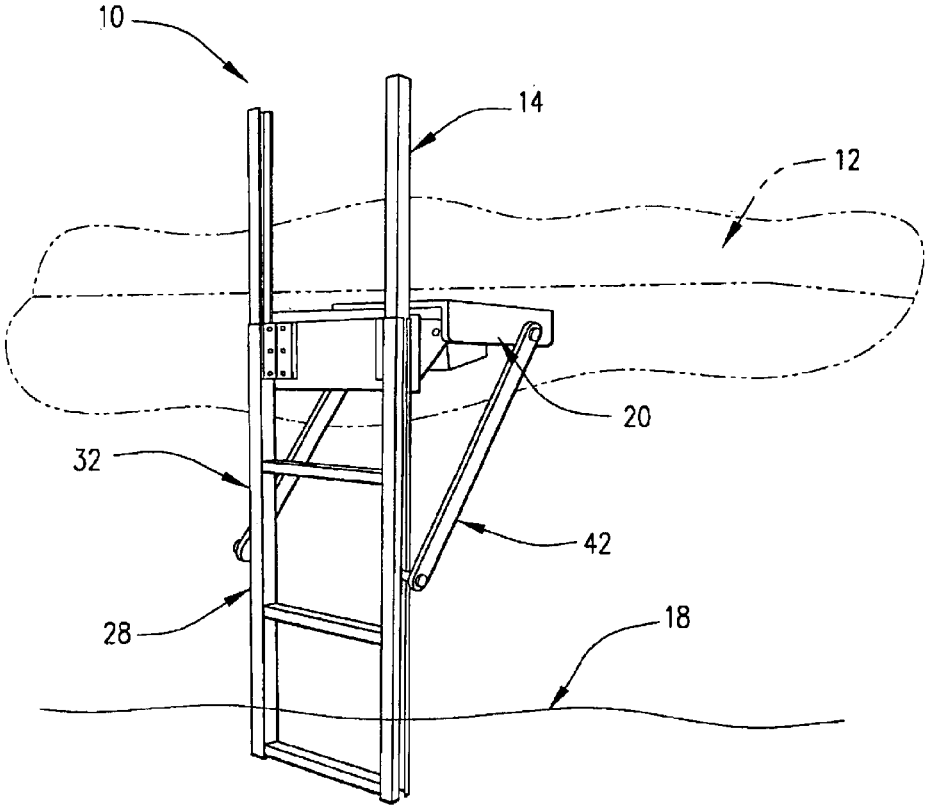
FIG. 1 is perspective view of a retractable ladder assembly constructed in accordance with the present invention and shown mounted to the stem of a pontoon boat in the extended position.
Figure 2:
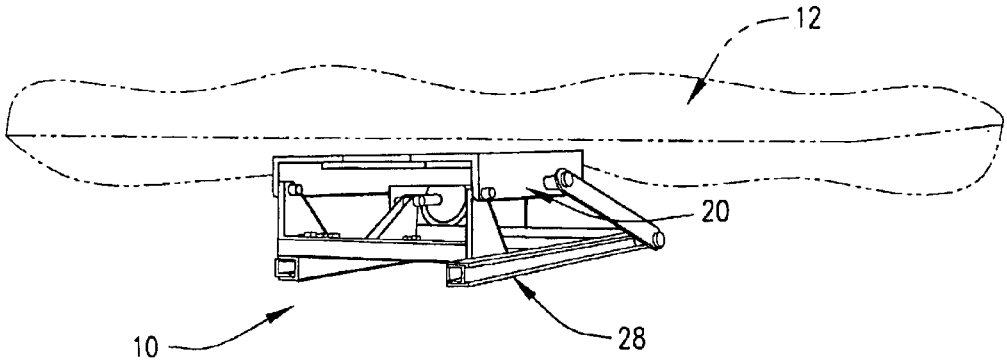
FIG. 2 is a perspective view of the retractable ladder assembly of FIG. 1 in the retracted position.
Figure 3:
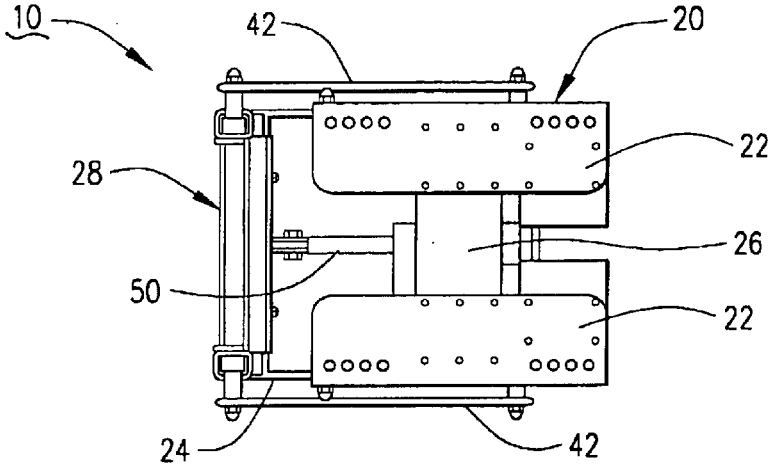
FIG. 3 is a top plan view of the retractable ladder assembly of FIG. 1 in the extended position.

Referring to the drawings in general, and more particularly to FIG. 1, shown therein is a retractable ladder assembly 10 constructed in accordance with the present invention. As will be discussed herein, the retractable ladder assembly 10 is constructed so as to have a retracted position and an extended position. The retractable ladder assembly 10 in FIG. 1, attached to a boat deck 12, is in the extended position with an upper portion 14 above the water and a lowered portion 16 partially extending into the water 18. FIG. 2 is a similar view and shows the retractable ladder assembly 10 in the retracted position under the boat 12. While illustrated attached to a boat stren, such as a pontoon boat, it will be appreciated that the retractable ladder of the present invention can as well be installed any suitable marine platform, such as a dock.

With reference now to FIGS. 3 through 6, the retractable ladder assembly 10 has a frame 20 with a mounting apparatus 22, a hinge 24 and a power actuator 26 supported thereby. The power actuator 26 can be any one of a number of commercially available actuators suitable for the purpose described herein. One such power actuator that has been found acceptable for the present invention is manufactured by Cook Manufacturing Inc., Duncan, Okla., the assignee of the present invention, and is described in now pending U.S. patent application Ser. No. 09/641,586 entitled "Hydraulic Actuator," filed Aug. 18, 2000, and assigned to the assignee of the present invention, the teaching of such patent application being herewith incorporated by reference.

Figure 4:
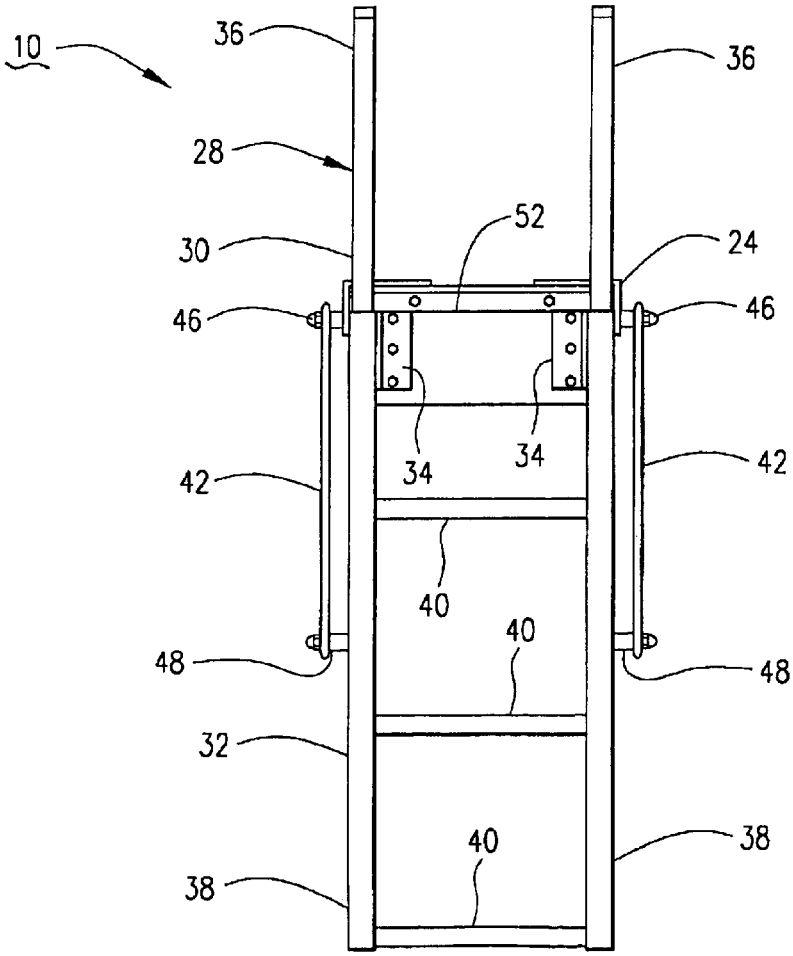
FIG. 4 is a front, elevational view of the retractable ladder assembly of FIG. 1 in the extended position.
Figure 3:
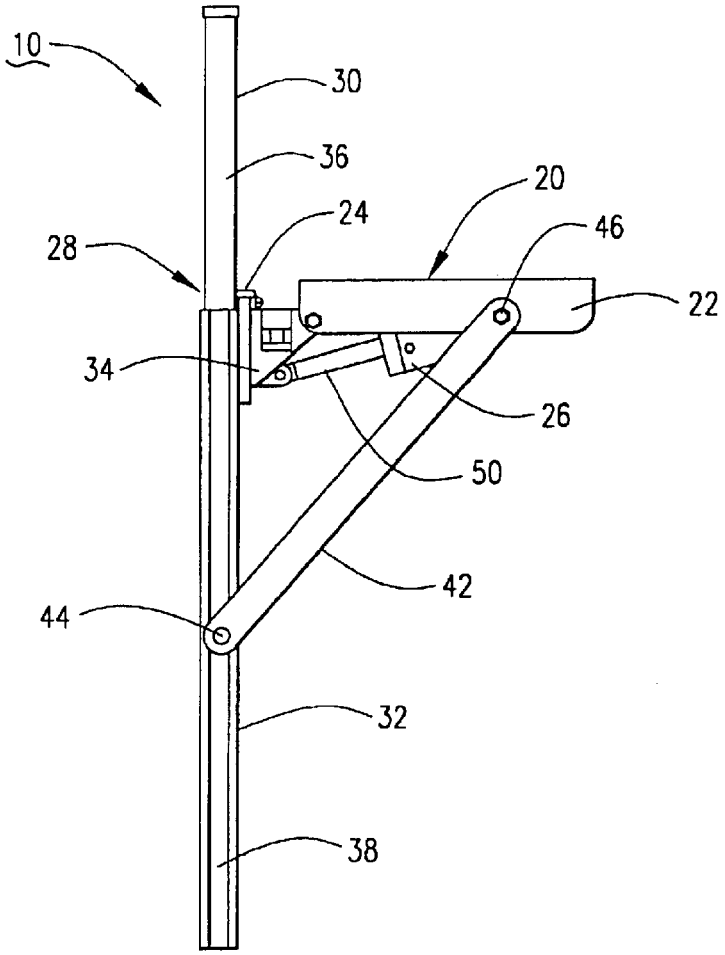
Figure 4:
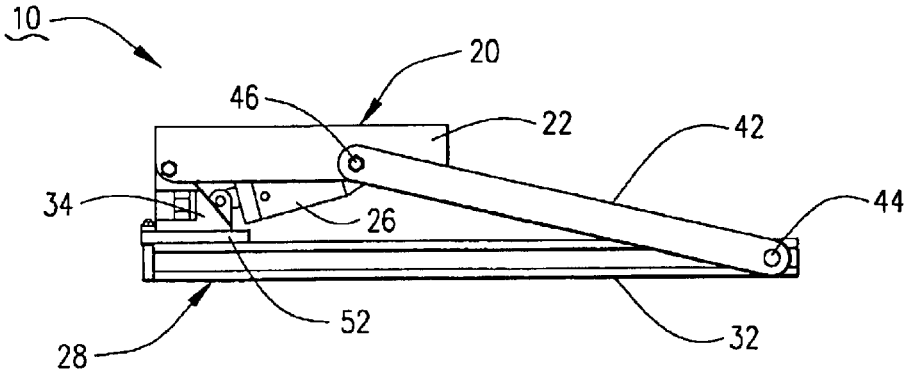
Figure 5:
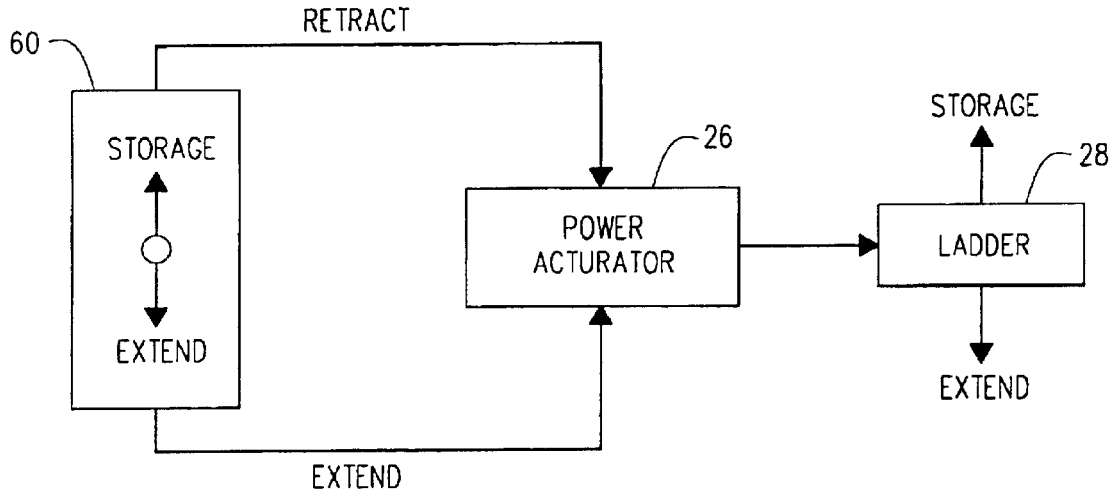
FIG. 5 is a side, elevational view of the retractable ladder assembly of FIG. 1 in the extended position.

As shown in FIGS. 4 and 5, the retractable ladder assembly 10 has a ladder 28 connected via the hinge 24 to the frame 20. The ladder 28 has an upper portion 30 and a lower portion 32 that are above and below the hinge 24, respectively, when the ladder 28 is in the deployed or extended position depicted in FIG. 4. The lower portion 32 is pivotally attached to the frame 20 via the hinge 24, which comprises a pair of pivot brackets 34. The upper portion 30 comprises a pair of longitudinally extending, channel extension members 36.

The lower portion 32 of the ladder 28 has a pair of channel members 38 held in spaced apart parallel disposition by interposed rung members 40. The channel members 38 are configured to slidably receive the channel extension members 36 therein; that is, each of the channel extension members 36 is slidably disposable in one of the channel members 38.

As shown in FIG. 5, each of the channel members 38 has a channel profile in which one of the channel extension members 36 in slidingly received. Each of a pair of strut connector members 42 has one end thereof pivotally connected to the lower end of one of the channel extension members 36 by a roller connector 44. Also, the other end of each of the strut connector members 42 is pivotally pinned to the frame 20 by a pin connector 46.

The frame 20 has a cross member 48, and the power actuator 26 is mounted on the underside of the cross member 48 as shown. A cross member 52 is attached to the upper ends of the channel members 38, the pivot brackets 34 connected to the cross member 52 to pivotally attach the channel members 38 to the frame 20. The power actuator 26 has an extendible rod 50 that is pivotally connected via a clevis connection to the cross member 52, and the power actuator 26 is disposed such that when the extendible rod portion 50 is retracted, the cross member 52 and attached channel members 38 fold beneath the frame 20 to assume a horizontal position as depicted in FIG. 6. When the extendible rod portion 50 of the power actuator 26 is extended, the cross member 52 and attached channel members 38 fold out to be disposed substantially perpendicular to the frame 20, and thus vertical, as depicted in FIG. 5.

Since the channel extension members 36 are slidably supported in the channel members 38 and are pivotally connected to the strut connector members 42, the channel extension members 36 are disposed beneath the frame 20 when the power actuator 26 is in the rod retracted position. The channel extension members 36 will be disposed in a substantially perpendicular (or vertical) position when the power actuator 26 is in the rod extended position.

That is, the ladder 28, in its extended position, will be substantially perpendicular to the boat deck 12, while the ladder 28 will be in a substantially horizontal, folded position in its retracted position. In this latter mentioned retracted position, the upper portion 30 slides together with the lower portion 32 as the power actuator 26 retracts so that the ladder 28 assumes the folded or retracted position under the boat deck 12, as shown in FIG. 6. And when the power actuator 26 extends, the upper portion 30 is caused to slide along the lower portion 32 as these pivot outwardly so that the ladder 28 will assume the extended position of FIG. 5.

As mentioned, the retractable ladder assembly 10 is shown in the retracted position in FIG. 6, having the ladder 28 stored beneath the frame 20. In this position, the power actuator 26 is retracted and the connector members 42 are positioned substantially parallel to, and beneath, the frame 20 and thus beneath the boat deck or platform 12 to which the frame 20 is mounted. And it should be noted that both the upper portion 30 and the lower portion 32 of the ladder 28 are tucked beneath the frame 20 and thus under the boat deck 12 to which the frame 20 is mounted.

Figure 7:
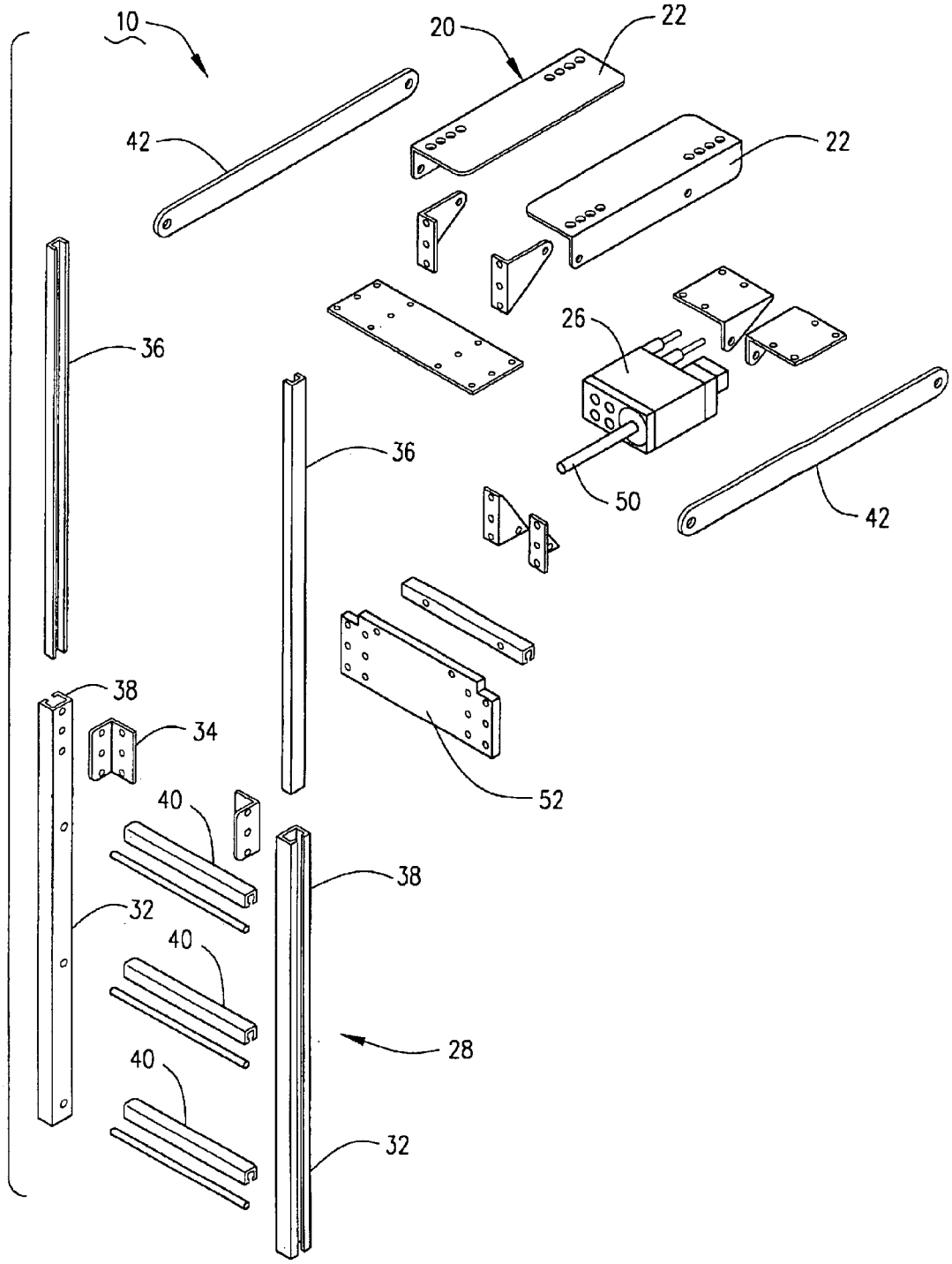
FIG. 7 is a perspective, exploded view of the retractable ladder assembly of FIG. 1.

FIG. 7 provides a list of parts that make up the retractable ladder assembly 10. Not all of the parts are separately designated as such is not believed necessary for the present disclosure to be understood to one skilled in the art; however, the components described hereinabove are numerically designated in FIG. 7, including the frame 20, ladder 28, power actuator 26 and strut connectors 42.

The power actuator 26 is provided preferably with an extend limit switch (not shown), and a retract limit switch (also not shown) respectively senses maximum travel at the end of the stroke of the extendible rod 50 thereof both in the extended and the retracted positions. As depicted in FIG. 8, a control toggle switch 60 is provided and electrically connected to the power actuator 26 such that, when closed downwardly, an extend signal is sent to the power actuator 26 to cause the ladder 28 to move to its extended position. As the extendible rod 50 of the power actuator 26 extends, both limit switches close. At the end of the travel stroke of the extendible rod 50 in that direction, the extend limit switch opens a control circuit (not shown) for the extend direction to stop the power actuator 26. In this state, the retract limit switch remains closed, which allows for operation in the retract direction.

When the control toggle switch 60 is closed upwardly to a storage or stow position, a retract signal is sent to the power actuator 26 to retract the extendible rod 50 and cause the ladder 28 to go to its retracted position. Again, as the power actuator 26 moves, both limit switches close. At the end of travel in that direction the retract limit switch opens the control circuit for the retract direction and the power actuator 26 stops. In this state, the extend limit switch remains closed, which allows for operation in the extend direction.

Down (Deploy) Operation

With the control toggle switch 60 in the up position, the retractable ladder assembly 10 is in the retracted or stowed position tucked under the boat deck 12, as shown in FIG. 6. To move the ladder 28 to the lowered or vertical position as shown in FIG. 5, the toggle switch 60 is moved to the down position, which starts the power actuator 26 to extend the ladder 28 toward the extended or vertical position. When the power actuator 26 reaches its end of travel, the ladder 28 is vertical, the down limit switch opens and the power actuator 26 stops. The ladder 28 is then ready to be used by personnel.

Up (Stow) Operation

With the retractable ladder assembly 10 in the extended or deployed position, the ladder 28 is vertically disposed and the toggle switch 60 is in the down position. To move the ladder 28 to the up or horizontal position, the toggle switch 60 is moved to the up position, starting the power actuator 26 to retract and thereby swing the ladder 28 toward the up or horizontal position. When the power actuator 26 reaches the end of travel, the ladder 28 is in the horizontal or retracted position, as shown in FIG. 6, and the up limit switch opens and the power actuator 26 stops. The ladder 28 is then in the retracted, stowed position under the boat deck 12.

Preferably, the materials of construction of the components of the retractable ladder assembly are selected to be corrosion resistant for marine environments.

It is clear that the present invention is well adapted to achieve the ends, benefits and advantages mentioned and those inherent herein. While a presently preferred embodiment of the invention has been described in varying detail for purposes of the disclosure, it will be understood that numerous changes may be made which will readily suggest themselves to ones skilled in the art and which are encompassed within the spirit of the invention disclosed and as defined by the above text and the accompanying drawings.

What is claimed is:

1. A retractable ladder assembly for extension from, and stowage under, a marine platform, the retractable ladder assembly comprising:

a frame supportable under the marine platform;

a ladder comprising;

a pair of channel members pivotally connected to the frame and extendible there from in a vertical position and in a horizontal position, a plurality of rung members extending between the channel members; and at least one channel extension member slidably supported in the channel members;

at least one strut connector having one end pivotally connected to the frame and the other end pivotally connected to the lower end of the channel extension member; and actuator means supported by the frame for pivoting the channel members between the vertical position and the horizontal position, the channel extension member extending from the upper end of the channel member in the vertical position and contained in the channel member in the horizontal position.

2. The assembly of claim 1 wherein ladder has a pair of channel extension members, each of the channel extension members slidably supported in one of the channel members.

3. The assembly of claim 2 wherein the channel members and channel extension members are substantially parallel.

4. The assembly of claim 3 wherein the actuator means comprises a power actuator having an extendible rod, the distil end of the extendible rod pivotally connected to the channel members near an upper end thereof.

5. The assembly of claim 4 further comprising a control toggle switch connected to the power actuator and having an extend position in which an extend signal is sent to the power actuator to extend the extendible rod, and having a storage position in which a retract signal is sent to the power actuator to retract the extendible rod.

6. The assembly of claim 5 further comprising a cross member connected to the upper ends of the channel members, and at least one bracket connected to the cross member and pivotally connected to the frame, the distal end of the extendible rod pivotally connected to the cross member.

7. The assembly of claim 6 wherein the ladder is made of a material that resists corrosion in a marine environment.

8. A retractable ladder assembly comprising:

a frame;

a ladder comprising:

a first channel member;

a second channel member; means for pivotally connecting the first and second channel members to the frame;

a plurality of rung members extending between and supported by the first and second channel members;

a pair of channel extension members, each of the channel extension members slidably supported in one of the first and second channel members;

a pair of strut connectors having first and second ends, the first end of each strut connectors pivotally connected to the frame and the second end of each strut connectors pivotally connected to the lower end of one of the channel extension members; and actuator means supported by the frame for pivoting the first and second channel members between a vertical position and a horizontal position, the channel extension members extending from the upper ends of the first channel member and the second channel member when in the vertical position and contained in the first and second channel members when in the horizontal position.

9. The assembly of claim 8 wherein the channel members and channel extension members are substantially parallel.

10. The assembly of claim 8 wherein the actuator means comprises a power actuator having an extendible rod, the distil end of the extendible rod pivotally connected to the channel members near an upper end thereof.

11. The assembly of claim 10 further comprising a control toggle switch connected to the power actuator and having an extend position in which an extend signal is sent to the power actuator to extend the extendible rod, and having a storage position in which a retract signal is sent to the power actuator to retract the extendible rod.

12. The assembly of claim 11 further comprising a cross member connected to the upper ends of the channel members, and at least one bracket connected to the cross member and pivotally connected to the frame, the distal end of the extendible rod pivotally connected to the cross member.

13. The assembly of claim 8 wherein the ladder is made of a corrosion resistive material for a marine environment.

* * * * *

UNITED STATES PATENT AND TRADEMARK OFFICE

CERTIFICATE OF CORRECTION

PATENT NO. : 6,789,648 B2
APPLICATION NO. : 10/339065
DATED : September 14, 2004
INVENTOR(S) : Gregory D. Cook It is certified that error appears in the above-identified patent and that said Letters Patent is hereby corrected as shown below:

Col. 2, line 10
replace "stem"
with --stern.--

Col. 2, line 41
replace "stren"
with --stern.--

Col. 3, line 10
replace "members 36 in slidingly"
with --members 36 is slidingly.--

Col. 5, line 20
replace "wherein ladder has"
with --wherein the ladder has.--

Col. 5, line 27
replace "the distil end"
with --the distal end.--

Signed and Sealed this

Twentieth Day of May, 2008

JON W. DUDAS
*Director of the United States Patent and Trademark Office*